US008668368B2

(12) United States Patent
Darland

(10) Patent No.: US 8,668,368 B2
(45) Date of Patent: Mar. 11, 2014

(54) STAKE WITH ILLUMINATED ORNAMENT

(71) Applicant: Jed A. Darland, Bellevue, WA (US)

(72) Inventor: Jed A. Darland, Bellevue, WA (US)

( * ) Notice: Subject to any disclaimer, the term of this patent is extended or adjusted under 35 U.S.C. 154(b) by 0 days.

(21) Appl. No.: 13/624,594

(22) Filed: Sep. 21, 2012

(65) Prior Publication Data

US 2013/0070447 A1 Mar. 21, 2013

Related U.S. Application Data

(60) Provisional application No. 61/537,214, filed on Sep. 21, 2011.

(51) Int. Cl.
*F21S 8/00* (2006.01)

(52) U.S. Cl.
USPC ..... 362/431

(58) Field of Classification Search
USPC ..... 362/431, 217.14
See application file for complete search history.

(56) References Cited

U.S. PATENT DOCUMENTS

| | | | | |
|---|---|---|---|---|
| D208,013 | S | 6/1967 | Carr-Harris | |
| D230,218 | S | 1/1974 | Frelling | |
| 5,109,896 | A | 5/1992 | Tomes | |
| 6,561,681 | B1 * | 5/2003 | Huang | 362/311.01 |
| D493,507 | S | 7/2004 | D'Astous | |
| D495,567 | S | 9/2004 | Gontar | |
| D577,966 | S | 10/2008 | Cosimo | |
| D579,281 | S | 10/2008 | Miller et al. | |
| D619,433 | S | 7/2010 | Brodek | |
| D619,862 | S | 7/2010 | Brodek | |
| D655,584 | S | 3/2012 | Katzin | |
| D664,016 | S | 7/2012 | Darland | |
| 2006/0245196 | A1 * | 11/2006 | Haynes | 362/351 |
| 2006/0250802 | A1 * | 11/2006 | Herold | 362/362 |
| 2007/0008718 | A1 * | 1/2007 | Cayton | 362/186 |

* cited by examiner

*Primary Examiner* — Evan Dzierzynski
(74) *Attorney, Agent, or Firm* — Graybeal Jackson LLP; Kevin D. Jablonski

(57) ABSTRACT

An embodiment may include a stake with an elongated stake body that includes a stake top end, a stake bottom end, and a substantially rectangular portion with a width and a depth. The stake may further include an elongated transparent ornament window disposed within the stake body proximate to the stake top end which includes a portion extending at least the width and a portion extending less than the depth. The stake may further include an ornament disposed within the ornament window and an elongated illumination passage defined by the stake body that extends though the stake body from the stake top end to the ornament window. The illumination passage may have a portion abutting the ornament window having an area less than the area of the ornament window.

17 Claims, 2 Drawing Sheets

STAKE WITH ILLUMINATED ORNAMENT

RELATED APPLICATIONS

This application claims priority to U.S. Provisional Application No. 61/537,214 filed on Sep. 21, 2011, which application is incorporated herein by reference in its entirety for all purposes.

BACKGROUND

Stakes are typically used to mark locations or items in the ground. For example, garden stakes placed near a plant indicate what type of plant is growing at that location. Users typically write on wooden stakes and use them as markers; however, such writing can fade, become disfigured, or wash away in the presence of moisture. Other stakes may have a more permanent indicator; however, such indicators may not be well illuminated and may be difficult to see in certain conditions.

SUMMARY

An embodiment may include a stake with an elongated stake body that includes a stake top end, a stake bottom end, and a substantially rectangular portion with a width and a depth. The stake may further include an elongated transparent ornament window disposed within the stake body proximate to the stake top end which includes a portion extending at least the width and a portion extending less than the depth. The stake may further include an ornament disposed within the ornament window and an elongated illumination passage defined by the stake body that extends though the stake body from the stake top end to the ornament window. The illumination passage may have a portion abutting the ornament window having an area less than the area of the ornament window. The portion abutting the ornament window may correspond to a profile of the ornament with the illumination passage and ornament being aligned along an axis.

In an embodiment, the stake may be configured for light to pass through the illumination passage, for the light to pass into the ornament window, and for the light to illuminate the ornament.

DETAILED DESCRIPTION

Figure 1A:
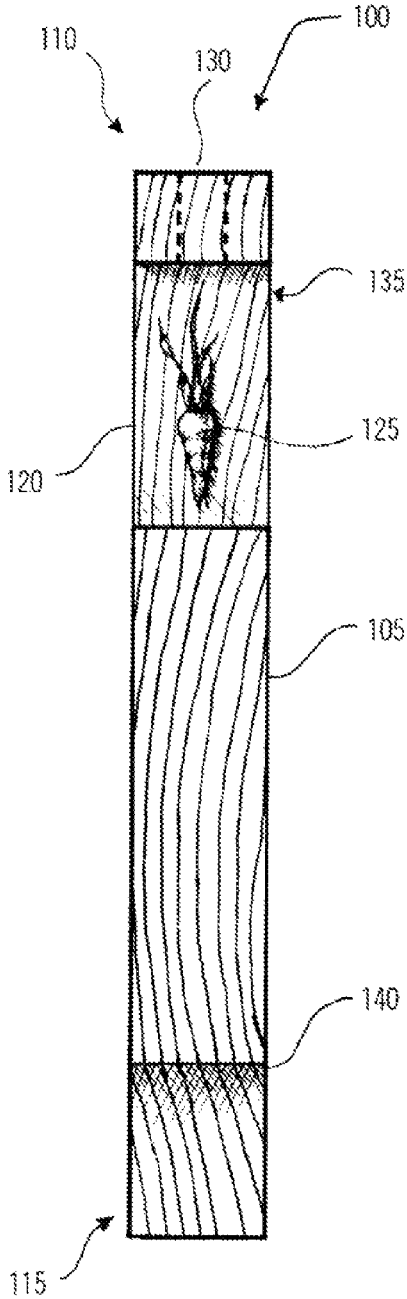
FIG. 1*a* is a front view of a stake with an illuminated ornament in accordance with an embodiment.
Figure 1B:
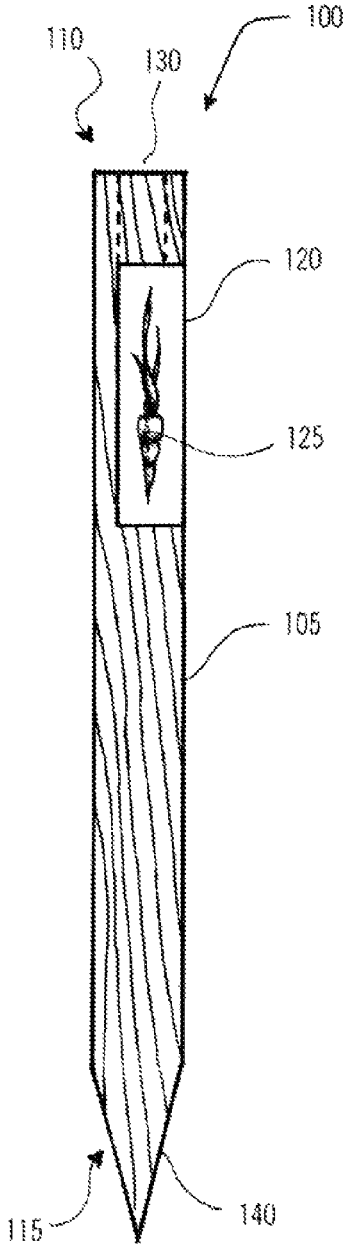
FIG. 1*b* is a side view of a stake with an illuminated ornament in accordance with the embodiment of FIG. 1*a*.
Figure 1C:
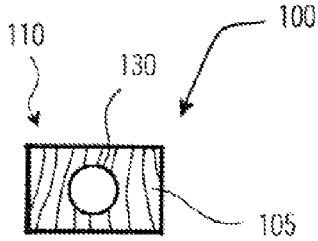
FIG. 1*c* is a top view of a stake with an illuminated ornament in accordance with the embodiment of FIG. 1*a*.

FIGS. 1*a*-1*c* depict a stake 100 in accordance with an embodiment. FIG. 1*a* depicts a front view of the stake 100, FIG. 1*b* depicts a side view of the stake 100, and FIG. 1*c* depicts a top view of the stake 100. The stake 100 comprises a stake body 105, which includes a top and bottom end 110, 115. Disposed within the stake body 105 and proximate to the top end 110 is an ornament window 120, which includes an ornament 125. Additionally, an illumination passage 130 extends between a top end 135 of the ornament window 120 and the top end 110 of the stake body 105. At the bottom end 115 of the stake 100, the stake body 105 defines a wedge 140.

In an embodiment, the stake body 105 may be made of any desirable material. For example, the stake body may comprise wood, plastic, glass, metal, ceramic, or the like. In an embodiment, the stake body 105 may be opaque, translucent, or transparent.

In an embodiment, the ornament window 120 may be made of any desirable material and may be transparent or translucent. For example, the ornament window 120 may comprise glass, plastic or the like. In an embodiment, the ornament window 120 may be a solid piece of plastic having an ornament 125 embedded within the ornament window 120. In one embodiment, the ornament window 120 may comprise one or more plastic piece that surrounds the ornament 125, which resides within a cavity (not shown). In one embodiment, a stake 100 may not include an ornament window 120, and the ornament 125 may simply reside within a cavity (not shown) defined by the stake body 105.

The stake body 105 may be rectangular with a width and a depth, with the ornament window 120 extending the width across the stake body (see e.g., FIG. 1*a*) and extending only a portion of depth (see e.g., FIG. 1*b*). While FIGS. 1*a* and 1*b* depict an ornament window 120 disposed within a portion of the width of the stake body 105, in an embodiment, the ornament window 120 may extend the full width of the stake body 105 such that the stake body 105 is divided into two portions.

The ornament 125 may be any suitable material and may take on any suitable form. For example, in the embodiment depicted in FIGS. 1*a*-1*c*, the stake 100 may be used in a garden and placed in the ground near plants or seeds. Given that the ornament 125 depicted in FIGS. 1*a*-1*c* is a carrot, the stake 100 may be placed near growing carrots. Accordingly, in some embodiments, it may be desirable for the ornament 125 to be various types of garden plants so that a stake 100 can be used to identify types of garden plants. In some embodiments, the ornament 125 may be abstract or may depict other objects. For example, in an embodiment, the ornament 125 may depict an insect, animal, person, tool, one or more letter, or the like. In some embodiments, there may be a plurality of ornaments 125.

The illumination passage 130 extends between a top end 135 of the ornament window 120 and the top end 110 of the stake body 105. The illumination passage 130 may be translucent or transparent and may be configured to allow light to pass through the illumination passage 130 and illuminate the ornament 125. For example, when the stake 125 is positioned in the ground with the top end 110 extending upward, sunlight may travel through the illumination passage 130 and illuminate the carrot ornament 125.

Figure 2A:
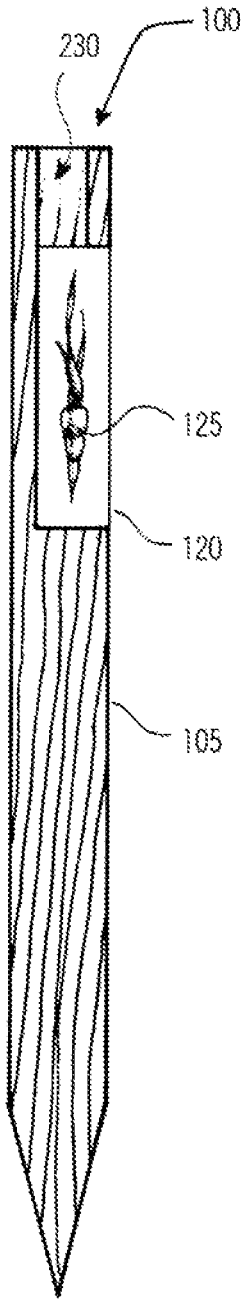
FIG. 2*a* is a side view of a stake with an illuminated ornament in accordance with an embodiment.

In an embodiment, the illumination passage 130 may comprise any suitable material including glass, plastic, or the like. In one embodiment, as depicted in FIG. 2*a*, the illumination passage 130 may be an illumination cavity 230 defined by the stake body 105, which allows light to pass therethrough.

In some embodiments, the illumination passage 130 or illumination cavity 230 may have a smaller profile or area than the ornament window 120. (e.g., have a smaller diameter or width than a diameter or width of the ornament window 120 or ornament window top end 135). However, in some embodiments, the illumination passage 130 or illumination cavity 230 may be any suitable size or shape.

In some embodiments, the size of the illumination passage 130 may correspond to a size or profile of the ornament 125. For example, referring to FIGS. 1*a*, 1*b* and 2*a*, the ornament 125 may have a vertical profile or maximum diameter or width, and the illumination passage 130 may have a corresponding size, diameter or width. In various embodiments, corresponding size of the illumination passage 130 and ornament 125 may be desirable because light that passes through the illumination passage 130 and illuminates the ornament 125, may be limited to substantially only the ornament 125 disposed within the ornament window 120. This may provide desirable contrast between the illuminated ornament 125 and the unilluminated portions of the ornament window 120. Accordingly, in some embodiments, the illumination passage 130 may act as a lens or mask that focuses or limits illumination substantially to the ornament 125. In various embodiments it may be desirable for the ornament 125 and illumination passage 130 to be aligned along a common axis.

In some embodiments, the illumination passage 130 may extend from the stake top end 110. For example, the illumination passage 130 may comprise a prism that focuses light into the illumination passage 130, and such a prism may extend from the stake top end 110.

Figure 2B:
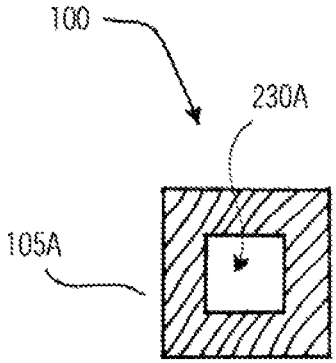
FIG. 2*b* is a top view of a stake with an illuminated ornament in accordance with an embodiment.
Figure 2C:
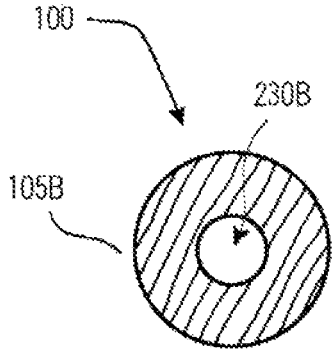
FIG. 2*c* is a top view of a stake with an illuminated ornament in accordance with an embodiment.
Figure 2D:
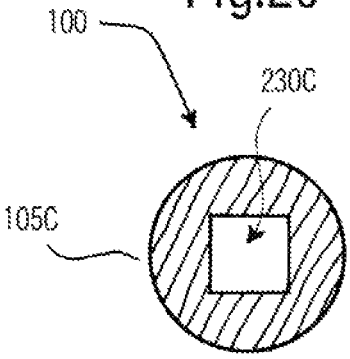
FIG. 2*d* is a top view of a stake with an illuminated ornament in accordance with an embodiment.

While FIGS. 1*a*-1*c* depict a stake 100 having a rectangular stake body 105 and a circular illumination passage 130, various shapes of a stake body 105 and illumination passage 130 or illumination cavity 230 are contemplated. For example, referring to FIG. 2*b* the stake body 105 may be rectangular and define a rectangular illumination cavity 230. Additionally, FIG. 2*c* depicts a circular stake body 105 and a circular illumination cavity 230; FIG. 2*d* depicts a circular stake body 105 and a rectangular illumination cavity 230. Similarly, the ornament window 125 may be various suitable sizes and shapes.

Additionally, in some embodiments, there may be a plurality of ornament windows 120, illumination passages 130, and ornaments 125. For example, there may be a first and second ornament window 120 in series, which are interconnected via a second illumination passage 130 which extends between the first and second ornament window 120.

In some embodiments, ornament windows 120 may be removable, replaceable, and interchangeable. For example, where a user desires a different ornament 125 in a stake 100, the user may remove the current ornament window 120 and replace it with an ornament window 120 having the desired ornament 125. Accordingly, an embodiment may comprise a set of a plurality of stake bodies 105 and a plurality of ornament windows 120 having different ornaments 125 therein.

Stakes may be made in various ways. For example, in one embodiment an ornament 125 may be cast in a plastic or resin to form an ornament window 120, and the ornament window 120 may be coupled with a stake body 105. In another embodiment, an ornament 125 may be cast in a plastic or resin within a cavity of a stake body 105 to form an ornament window 120. In embodiments where the illumination passage 130 comprises a solid material, the illumination passage 130 may be formed and coupled with a stake body 105, or the illumination passage 130 may be cast within a cavity 230 of a stake body 105 to form an illumination passage 130

From the foregoing it will be appreciated that, although specific embodiments have been described herein for purposes of illustration, various modifications may be made without deviating from the spirit and scope of the disclosure. Furthermore, where an alternative is disclosed for a particular embodiment, this alternative may also apply to other embodiments even if not specifically stated.

The invention claimed is:

1. A stake, comprising:

an elongated stake body having a stake top end and stake bottom end;

an elongated ornament window disposed within the stake body proximate to the stake top end and including;

an ornament disposed within the ornament window; and an elongated illumination passage extending though the stake body from the stake top end to the ornament window top end with a portion abutting the ornament window top end.

2. The stake of claim 1, wherein the ornament window is substantially transparent; and wherein the stake is configured for light to pass through the illumination passage, for the light to pass into the ornament window, and for the light to illuminate the ornament.

3. The stake of claim 1, wherein widths of the ornament window are greater than widths of the illumination passage.

4. The stake of claim 1, wherein the portion of the illumination passage abutting the ornament window has a cross section surface that is less than the area of the ornament window.

5. The stake of claim 1, wherein the stake is configured for light to pass through the illumination passage, for the light to pass into the ornament window, and for the light to illuminate a portion of the ornament window comprising substantially only the ornament.

6. The stake of claim 1, wherein the illumination passage further comprises a hollow passage defined by the stake body.

7. The stake of claim 1, wherein stake body further comprises a substantially rectangular portion.

8. The stake of claim 7, wherein a portion of the ornament window extends the width of the rectangular portion.

9. The stake of claim 7, wherein a portion of the ornament window extends less than the full depth of the rectangular portion.

10. The stake of claim 1, wherein the illumination passage is substantially cylindrical.

11. The stake of claim 10, wherein the illumination passage further comprises a diameter about equal to a largest vertical diameter of the ornament.

12. The stake of claim 1, wherein the illumination passage comprises a transparent solid body.

13. The stake of claim 1, wherein the illumination passage and ornament are aligned along an axis.

14. The stake of claim 1, wherein the stake bottom end further comprises a wedge.

15. The stake of claim 1, wherein the ornament window is removable.

16. A stake, comprising:

an elongated stake body including:

a stake top end;

a stake bottom end; and a substantially rectangular portion with a width and a depth;

an elongated transparent ornament window disposed within the stake body proximate to the stake top end and comprising:

a portion extending at least the width; and a portion extending less than the depth, an ornament disposed within the ornament window; and an elongated illumination passage defined by the stake body and extending though the stake body from the stake top end to the ornament window with a portion abutting the ornament window having an area less than the area of the ornament window and the portion abutting the ornament window top end corresponding to a profile of the ornament, the illumination passage and ornament being aligned along an axis.

17. The stake of claim 16, wherein the stake is configured for light to pass through the illumination passage, for the light to pass into the ornament window, and for the light to illuminate the ornament.

* * * * *